US012721442B2

(12) United States Patent
Donati

(10) Patent No.: US 12,721,442 B2
(45) Date of Patent: Sep. 1, 2026

(54) OSCILLATION MECHANISM FOR A CHAIR OR AN ARMCHAIR

(71) Applicant: DONATI S.P.A., Rodengo Saiano (IT)

(72) Inventor: Armando Donati, Rodengo Saiano (IT)

(73) Assignee: DONATI S.P.A, Rodengo Saiano (IT)

( * ) Notice: Subject to any disclaimer, the term of this patent is extended or adjusted under 35 U.S.C. 154(b) by 120 days.

(21) Appl. No.: 18/723,775

(22) PCT Filed: Jan. 11, 2023

(86) PCT No.: PCT/IB2023/050239

§ 371 (c)(1),
(2) Date: Jun. 24, 2024

(87) PCT Pub. No.: WO2023/144639

PCT Pub. Date: Aug. 3, 2023

(65) Prior Publication Data

US 2025/0098860 A1 Mar. 27, 2025

(30) Foreign Application Priority Data

Jan. 28, 2022 (IT) ..... 102022000001481

(51) Int. Cl.
*A47C 3/025* (2006.01)
*A47C 1/032* (2006.01)
*A47C 3/026* (2006.01)

(52) U.S. Cl.
CPC ..... *A47C 3/0252* (2013.01); *A47C 1/03266* (2013.01); *A47C 1/03277* (2013.01); *A47C 3/026* (2013.01)

(58) Field of Classification Search
CPC ..... A47C 3/0252; A47C 1/03266; A47C 1/03277; A47C 3/026
See application file for complete search history.

(56) References Cited

U.S. PATENT DOCUMENTS 2,313,559 A * 3/1943 Larsen ..... A47C 3/025 297/302.1
3,369,840 A * 2/1968 Dufton ..... A47C 1/03255 297/300.1

(Continued)

FOREIGN PATENT DOCUMENTS

GB 1046574 A * 10/1966 ..... A47C 3/026
IT 201800003431 A1 9/2019

(Continued)

OTHER PUBLICATIONS

International Search Report for International Patent Application No. PCT/IB2023/050239, mailed Apr. 17, 2023.

(Continued)

*Primary Examiner* — Milton Nelson, Jr.
(74) *Attorney, Agent, or Firm* — Armstrong Teasdale LLP

(57) ABSTRACT

An oscillation mechanism for a chair or an armchair having a seat and a backrest is provided. The oscillation mechanism has a functional body hingeable to the seat and/or the backrest and having at least one flexible functional portion that is elastically deformable, and an adjustment device having a movable engagement member and an auxiliary portion having a first end connected to the at least one flexible functional portion and a free end. The adjustment device is configurable in a high-flexibility configuration in which the auxiliary portion is configured in a cantilever fashion, and a reduced flexibility configuration in which the movable engagement member engages the free end, so that the auxiliary portion elastically bends together with the at least one flexible functional portion.

15 Claims, 9 Drawing Sheets

(56) References Cited

U.S. PATENT DOCUMENTS 3,416,839 A * 12/1968 Flint ..... A47C 1/03255
297/301.1
5,267,777 A * 12/1993 Valtri ..... A47C 7/441
297/302.1
5,356,199 A * 10/1994 Elzenbeck ..... A47C 7/445
297/313
6,752,458 B1 * 6/2004 Rivera ..... A47C 3/0252
267/158

FOREIGN PATENT DOCUMENTS

| | | | |
|---|---|---|---|
| WO | 2010097818 | A1 | 9/2010 |
| WO | 2011104735 | A1 | 9/2011 |
| WO | 2015145216 | A1 | 10/2015 |
| WO | 2021156672 | A1 | 8/2021 |

OTHER PUBLICATIONS

Italian Search Report for Italian Patent Application No. 2022000001481, mailed Sep. 6, 2022, The Hague, NL.

* cited by examiner

OSCILLATION MECHANISM FOR A CHAIR OR AN ARMCHAIR

CROSS-REFERENCE TO RELATED APPLICATIONS

This application is a National Phase Application of PCT International Application No. PCT/IB2023/050239, having an International Filing Date of Jan. 11, 2023, which claims priority to Italian Application No. 102022000001481, filed Jan. 28, 2022, each of which is hereby incorporated by reference in its entirety.

FIELD OF THE INVENTION

The present invention is in the field of oscillation mechanisms for chair or armchair seats, such as office seats.

BACKGROUND OF THE INVENTION

In this field, considerable research and development efforts are aimed at maximizing the comfort perceived by the user of the end product.

In the field of chairs and armchairs, particularly for office use, it is important to ensure that there are many ways of adjusting the seat, such as the seat height, and the inclination of the backrest and seat, so that the user may best adjust their position.

Modern seating solutions include an oscillating backrest, for example in case the user rests his/her back against it, but also a rocker seat, which is capable of adapting to the position of the user, for example sitting far from or very close to the backrest.

The possibility of oscillating the backrest and the seat is provided by an oscillating mechanism bearing the seat and the backrest of the chair, supported at a predefined height by a stem, typically also adjustable in height.

Some oscillation mechanism solutions are shown in the documents WO-A1-2010/097818, WO-A1-2011/104735, WO-A1-2015/145216, WO-A1-2021/156672 and IT201800003431, in the name of the Applicant. Further examples of oscillation mechanisms are described in documents U.S. Pat. No. 5,356,199 and WO-A1-2021/156672.

The new solutions in the sector aim to reduce or contain the complexity of these mechanisms, using a limited number of parts.

Furthermore, it is necessary to allow for the adjustment of the oscillations of the chair or armchair, according to the usage preferences and requirements.

SUMMARY OF THE INVENTION

The object of the present invention is to provide an oscillation mechanism for a chair or an armchair that meets the needs of the aforementioned sector.

This purpose is achieved by an oscillation mechanism and a chair or an armchair as described and claimed herein. Additional advantageous embodiments of the present invention are also described.

BRIEF DESCRIPTION OF THE FIGURES

The features and advantages of the oscillation mechanisms according to this invention will become apparent from the following description, given as a non-limiting example in accordance with the figures in the accompanying drawings, wherein.

DETAILED DESCRIPTION

Figure 1:
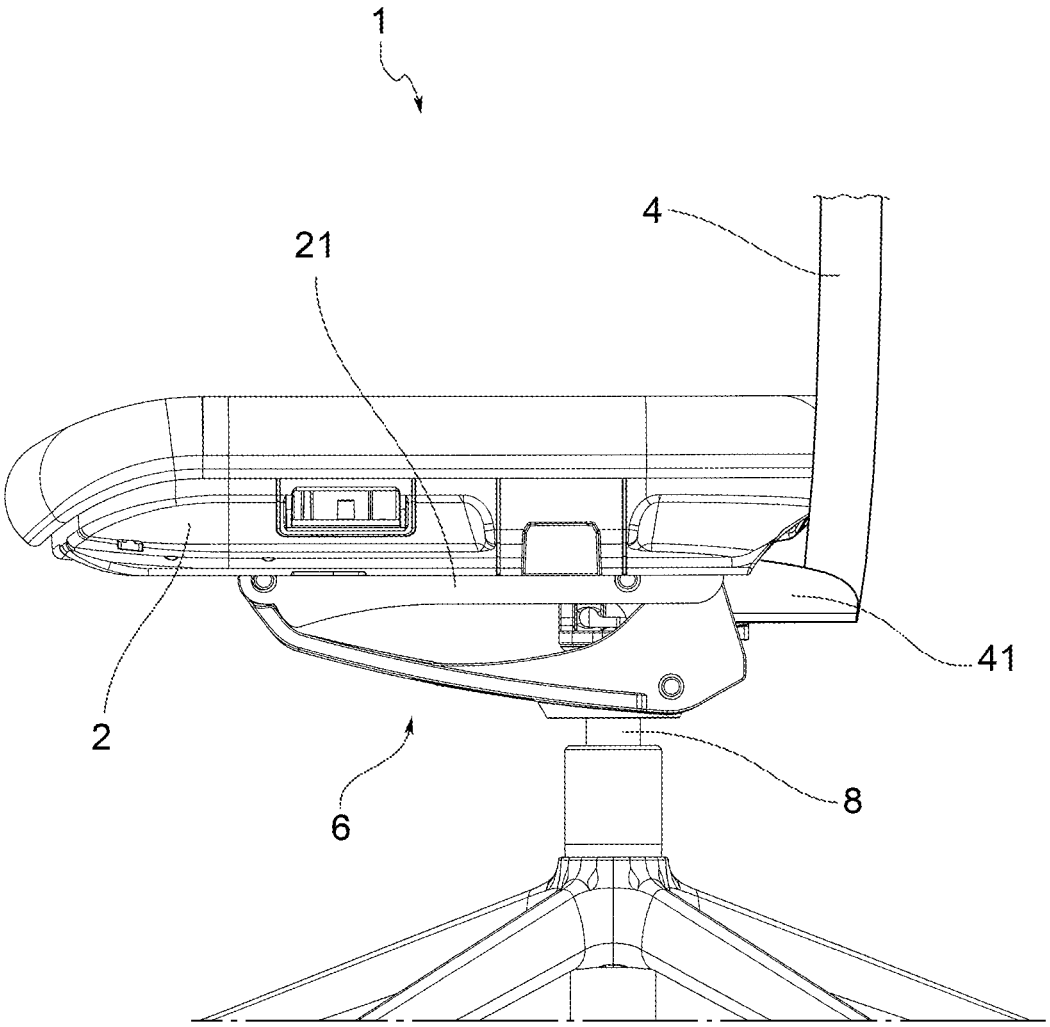
FIG. 1 shows a chair equipped with an oscillation mechanism according to one embodiment of the present invention.

With reference to the figures of the attached drawings, 1 indicates a chair or an armchair 1, comprising a seat 2, a backrest 4, an oscillation mechanism 6 and a stem 8.

The stem 8, for example consisting of a gas piston, supports the oscillation mechanism 6 at a predefined height in relation to a ground plane, and is adjustable according to the needs of the user.

Preferably, the oscillation mechanism 6 comprises a seat attachment 10 which is mechanically connectable, for example by means of screws, to the seat 2 of the chair or armchair 1.

Preferably, the oscillation mechanism 6 comprises a backrest attachment 41 which is mechanically connectable, for example by screws, to the backrest 4 of the chair or armchair 1.

The oscillation mechanism 6 comprises a functional body 3 extending in length between a front portion 11, where it has a front hinge axis 20, and a rear portion 12, where it has a rear hinge axis 40.

Preferably, in the front portion 11, the functional body 3 is provided with a plurality of hinge elements 110 mutually spaced apart and provided with front holes 115, passing transversely, which define the front hinge axis 20. Preferably, in the rear portion 12, the functional body 3 is provided with a plurality of transversely passing rear holes 125 defining the rear hinge axis 40.

The functional body 3 is hingeable posteriorly to the backrest 4, preferably to the backrest attachment 41, for example by means of a rear hinge pin extending along the rear hinge axis 40.

In addition, the functional body 3 is hingeable at the front to the seat 2, preferably to the seat attachment 21, for example by means of a front hinge pin extending along the front hinge axis 20.

Preferably, moreover, the seat attachment and the backrest attachment are hinged in a second rear hinge axis, for example by means of a second rear hinge pin.

The functional body 3 also comprises a connecting hole 100 that extends vertically in the rear portion 12, is open on a lower side 140 of the functional body 3 and engageable with the stem 8.

The functional body 3 is configured to be elastically deformable, e.g., under flexion, between the front hinge axis 20 and the rear hinge axis 40.

In particular, for the oscillation of the seat 2 and/or the backrest 4, the functional body 3 includes at least one flexible functional portion 15 that is bendable, e.g., elastically deformable under flexion, between the front hinge axis 20 and the rear hinge axis 40.

The oscillation mechanism 6 further comprises an adjustment device 5 that is configurable so as to adjust the flexibility of the functional body 3. In particular, the adjustment device 5 makes it possible to adjust the reaction of the chair or armchair 1 when a user moves, for example when stretched out on the backrest 4.

The adjustment device 5 comprises a support portion 31, connected to the at least one flexible functional portion 15 of the functional body 3, and a movable engagement member 38 supported by said support portion 31.

In particular, the movable engagement member 38 is movable in a plurality of positions, each corresponding to a configuration of the adjustment device 5.

The adjustment device 5 further comprises an auxiliary portion 33 provided with a first end 35 connected to the at least one flexible functional portion 15, and a second end or free end 37.

The adjustment device 5 is configurable in a first configuration or high-flexibility configuration, in which the movable engagement member 38 is disengaged from the free end 37 of the auxiliary portion 33, so that the auxiliary portion 33 is configured in a cantilever fashion. In addition, the adjustment device 5 is configurable in a second configuration or reduced flexibility configuration, in which the movable engagement member 38 engages the free end 37, so that the auxiliary portion 33 bends elastically, e.g., under flexion, between the front hinge axis 20 and the rear hinge axis 40 together with the at least one flexible functional portion 15.

In other words, with the adjustment device 5 configured in the high-flexibility configuration, the stresses exerted by the user on the chair or armchair 1 bear upon the at least one flexible functional portion 15, which undergoes accentuated bending, resulting in a particularly flexible functional body 3.

Preferably, in the high-flexibility configuration, the auxiliary portion 33 is substantially free of bending.

According to one embodiment, due to the deformation of the at least one flexible functional portion 15, the free end 37 makes a movement in a longitudinal direction, for example approaching the movable engagement member 38.

Otherwise, with the adjustment device 5 configured in the reduced flexibility configuration, the stresses acting on the functional body 3 are discharged onto the at least one flexible functional portion 15 and also onto the auxiliary portion 33. The auxiliary portion 33 is therefore subjected to the stresses imparted by the seated user, i.e. receiving part of said stresses, offering resistance to the deformation between the front hinge axis 20 and the rear hinge axis 40. This makes it possible to have a functional body 3 that, overall, is rigid or less elastic with respect to the high flexibility configuration.

That is to say that, with the same stresses generated by the movement of the user, in the reduced flexibility configuration, the seat 2 and/or the backrest 4 undergo oscillations of a smaller amplitude.

The mechanical properties of the elastic bending strength of the at least one flexible functional portion 15 and the auxiliary portion 33 are conferred by the specific geometry thereof and/or by virtue of the materials of which they are made.

According to one embodiment, the flexible functional portion 15 has a planar shape, having dimensions mainly in length, i.e. transversely to the front hinge axis 20 and the rear hinge axis 40, and in width, i.e. parallel to the front hinge axis 20; whilst it is provided with a vertical dimension or reduced thickness.

According to a different embodiment, the flexible functional portion 15 has the shape of a septum or rod, having a prevailing longitudinal dimension, whilst the other two dimensions, the thickness and width, are substantially smaller.

According to one embodiment, the adjustment device 5 comprises two flexible functional portions 15 that extend predominantly between the front hinge axis 20 and the rear hinge axis 40.

For example, the flexible functional portions 15 are spaced along the front hinge axis 20, i.e. along the transverse dimension of the functional body 3, defining an auxiliary region 150 therebetween. Preferably, the auxiliary portion 33 is spaced apart from both of said flexible functional portions 15 in said auxiliary region 150, along the longitudinal direction.

In addition, the adjustment device 5 comprises a joining portion 34, preferably made in one piece with the auxiliary portion 33, which connects said flexible functional portions 15 to the auxiliary portion 33.

Preferably, the auxiliary portion 33 extends longitudinally from the joining portion 34.

According to one embodiment, the joining portion 34 is proximal to the front hinge axis 20 and the support portion 31 is proximal to the rear hinge axis 40.

According to a different embodiment, the joining portion 34 is proximal to the rear hinge axis 40 and the support portion 31 is proximal to the front hinge axis 20.

According to one embodiment, the support portion 31 and the movable engagement member 38 are positioned in a control zone 39 proximal to the free end 37 of the auxiliary portion 33.

According to one embodiment, the movable engagement member 38 is movable along a straight control axis C, parallel to the front hinge axis 20 and/or the rear hinge axis 40.

According to a different embodiment, the movable engagement member 38 is movable along a circular or curvilinear section.

For example, the movable engagement member 38 has a control slot 72 and is engaged so as to be free to slide along a transverse guide 315 of the support portion 31, for example fixed by means of a screw 71 passing through said control slot 72.

Figure 2:
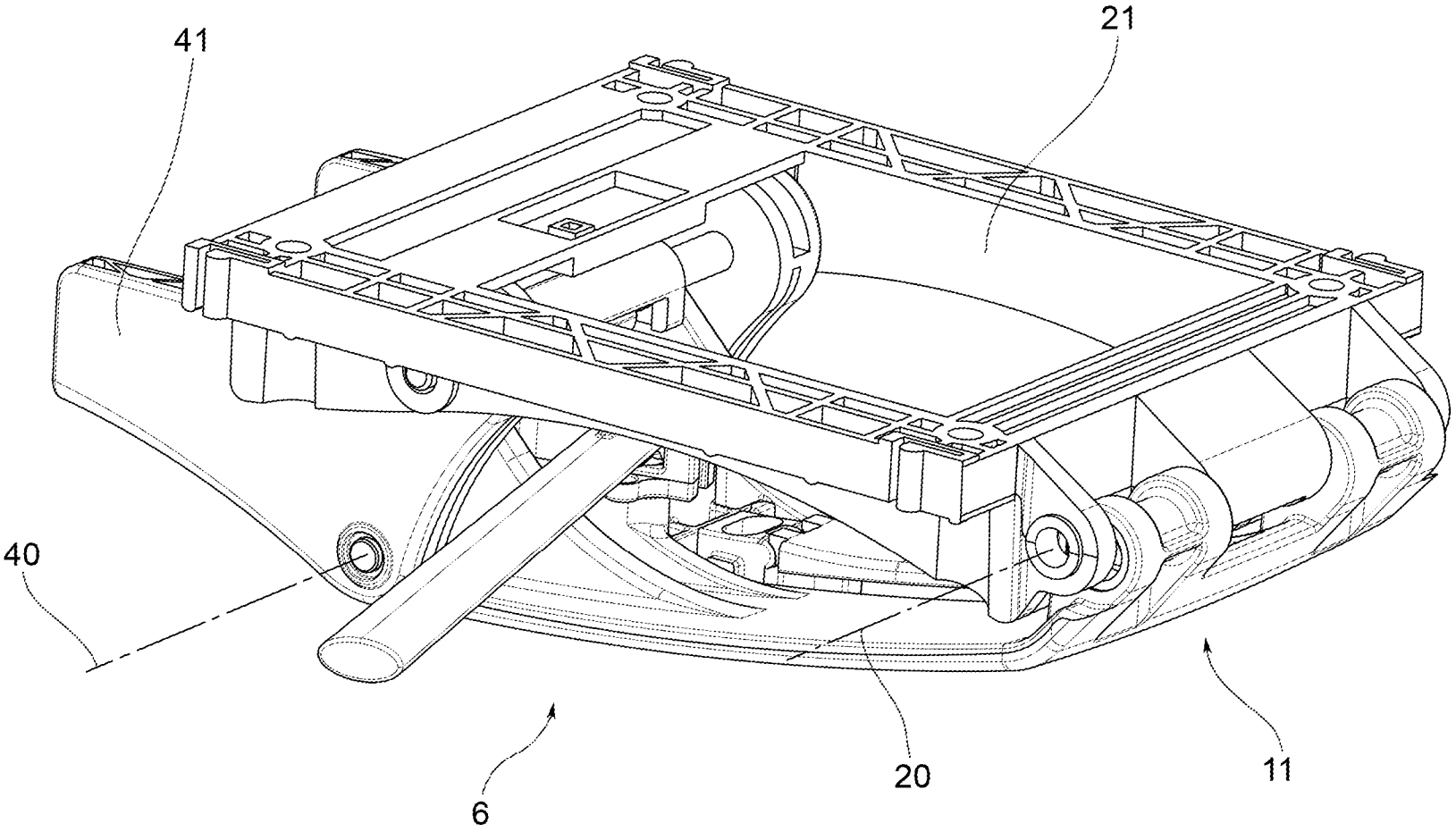
FIG. 2 shows the oscillation mechanism of FIG. 1.
Figure 3:
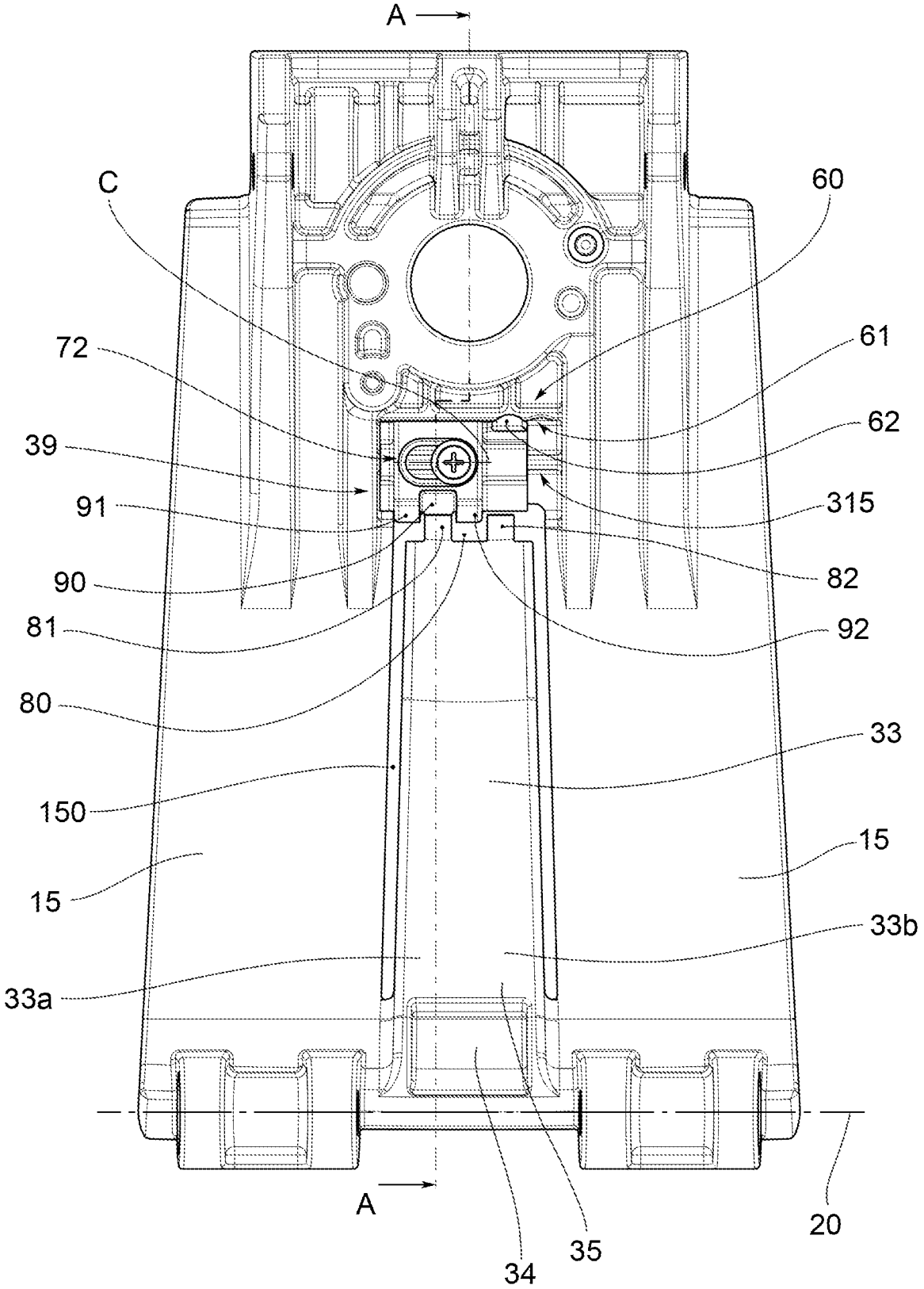
FIG. 3 shows an oscillation mechanism with an adjustment device in the high flexibility configuration.
Figure 4:
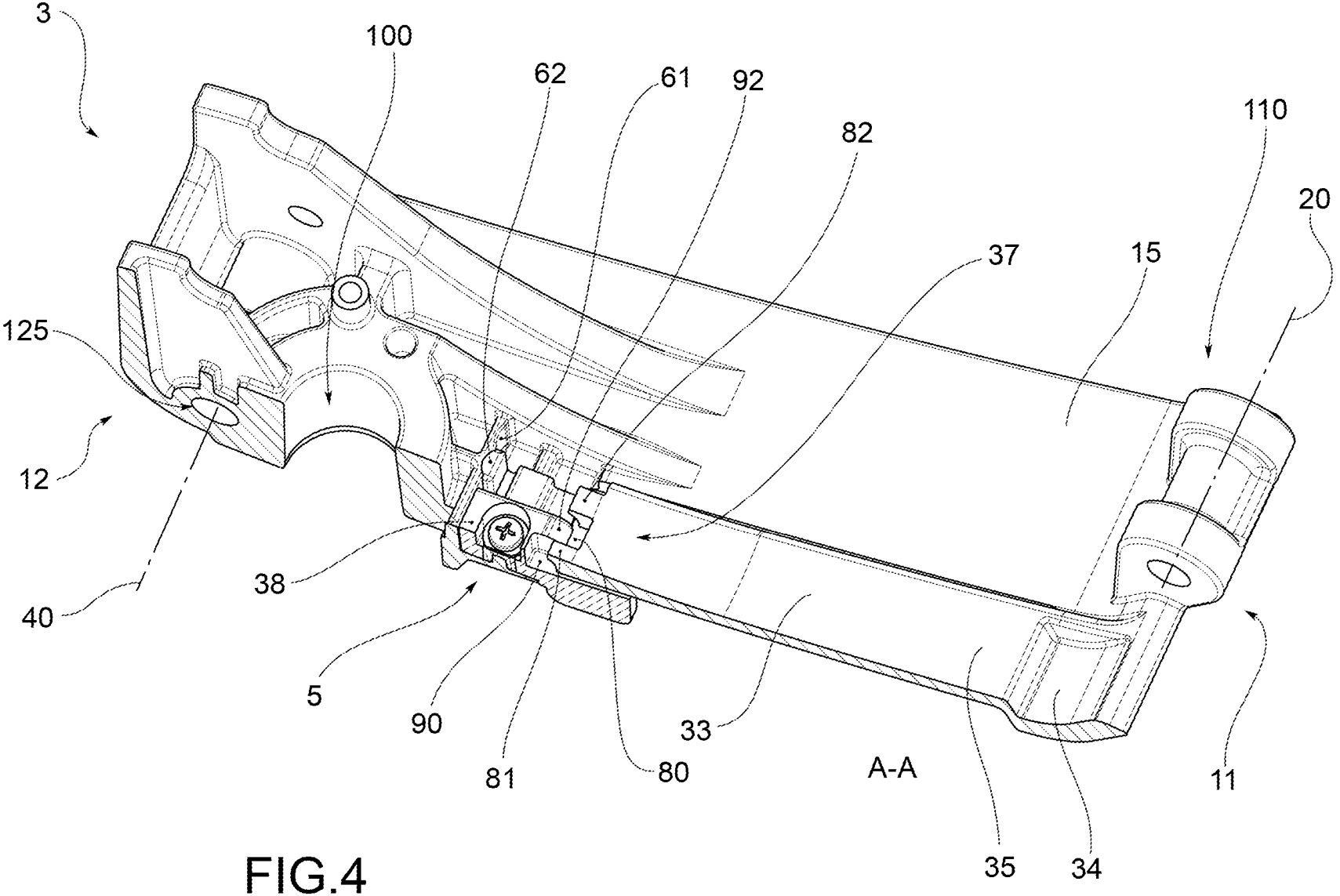
FIG. 4 shows a section of the oscillation mechanism of FIG. 3 along the section plane A-A.
Figure 5:
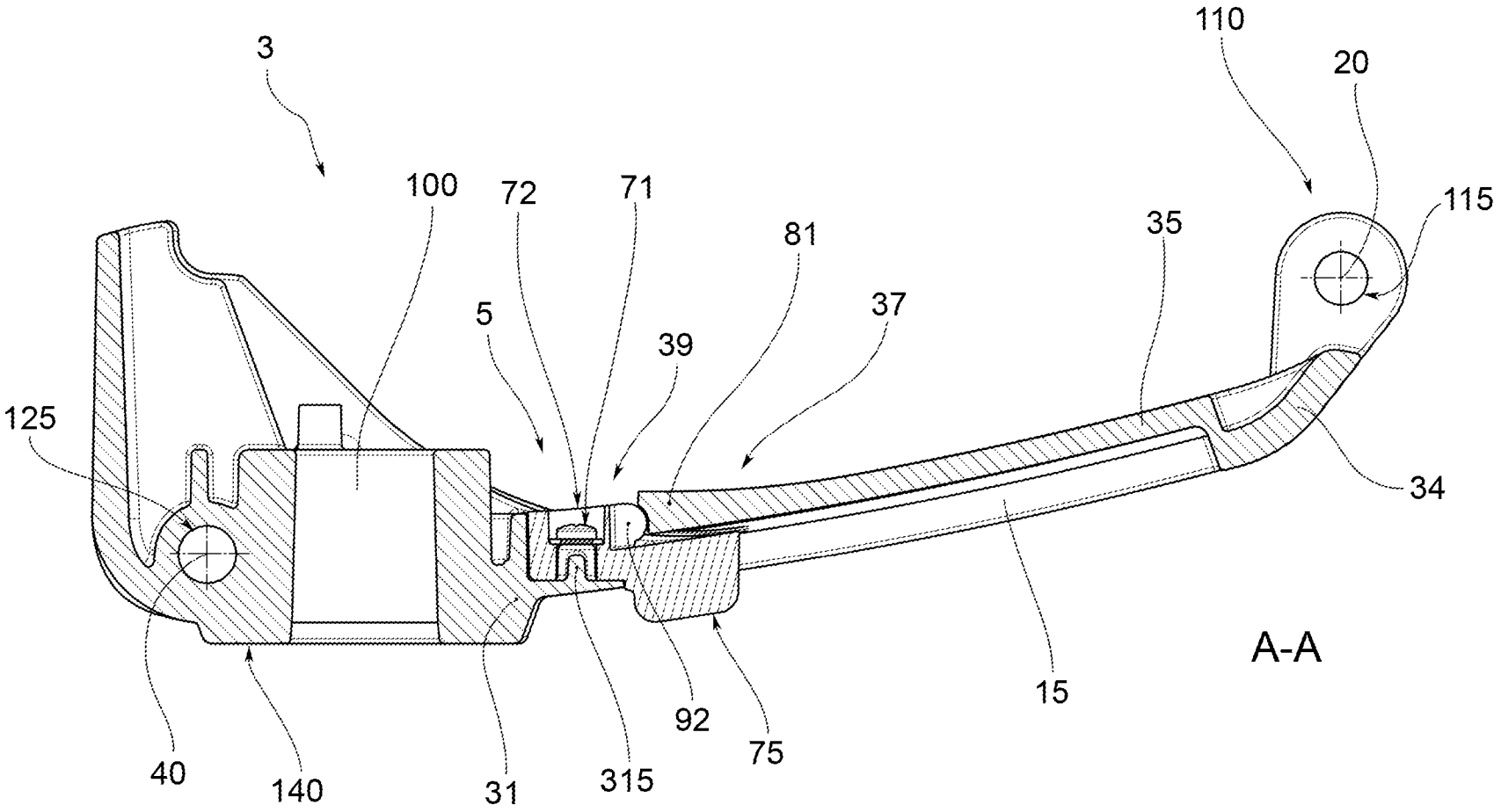
FIG. 5 shows a section of the oscillation mechanism of FIGS. 3 and 4.
Figure 6:
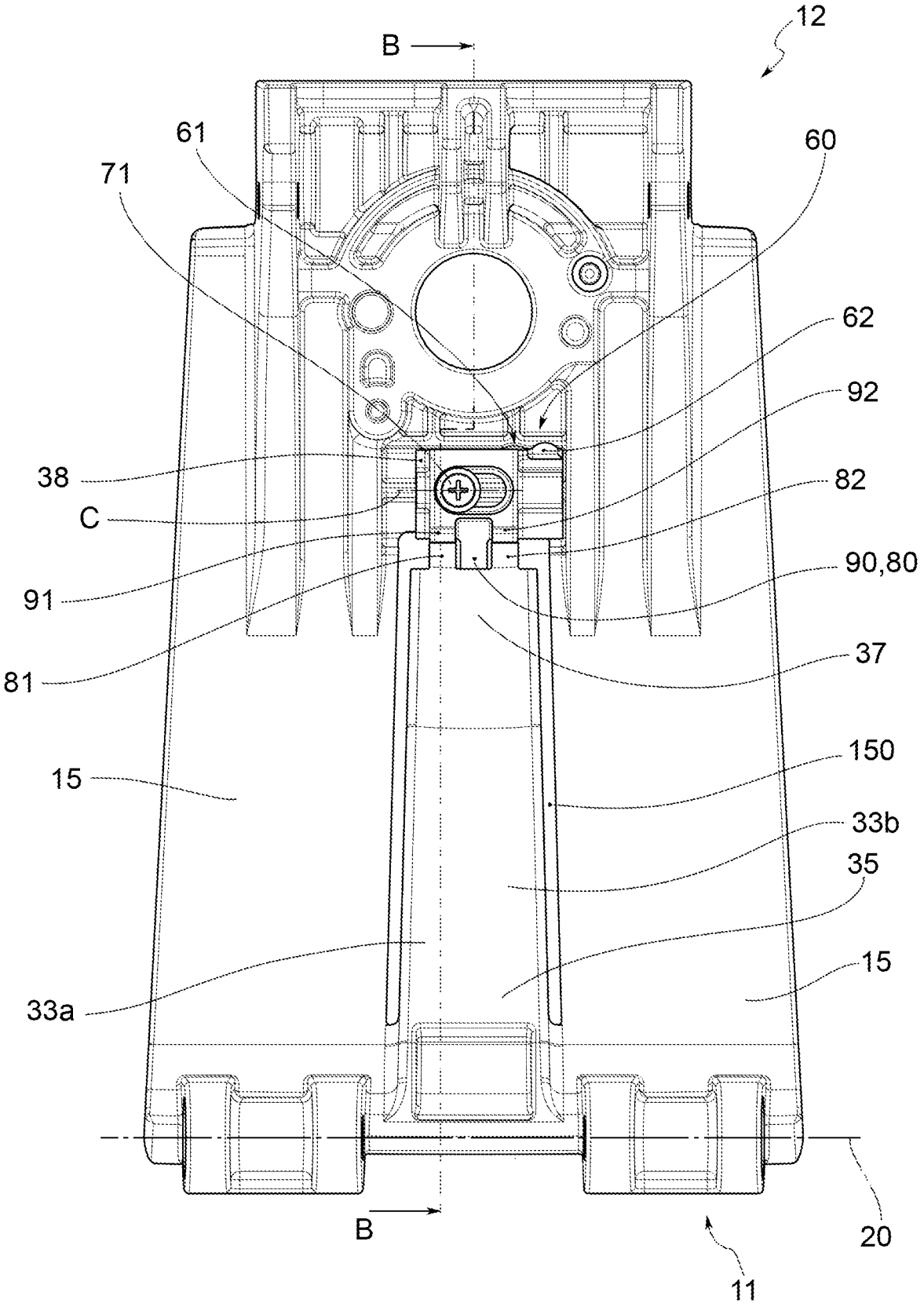
FIG. 6 shows an oscillation mechanism with an adjustment device in the reduced flexibility configuration.

In particular, the movable engagement member 38 is positionable in a first position or release position, corresponding to the high-flexibility configuration (FIG. 2), and a second position or working position, corresponding to the reduced flexibility configuration (FIG. 5), for example opposite to the release position along the control axis C.

According to one embodiment, the auxiliary portion 33 comprises a first auxiliary tooth 81 positioned at the free end 37, for example protruding from the free end 37, and the movable engagement member 38 comprises a first member tooth 91 and a member seat 90, preferably adjacent along the control axis C.

In the high-flexibility configuration, the first auxiliary tooth 81 is still or freely movable when leaving and entering the member seat 90, substantially along the longitudinal direction, during the deformation of the at least one flexible functional portion 15.

In the reduced flexibility configuration, however, the first member tooth 91 is engaged abutting against the first auxiliary tooth 81 and prevents the movement thereof, so that the auxiliary portion 33 is locked between the joining portion 34 and the movable engagement member 38.

According to one embodiment, the auxiliary portion 33 also comprises a second auxiliary tooth 82 spaced apart from and aligned with the first auxiliary tooth 81 along the control axis C, with which it defines an auxiliary seat 80. Furthermore, the movable engagement member 38 comprises a second member tooth 92, spaced apart from and aligned with the first member tooth 91 along the control axis C, with which it defines the member seat 90.

In the high-flexibility configuration, the second member tooth 92 is still or freely movable when leaving and entering the auxiliary seat 80, substantially along the longitudinal direction, during the deformation of the at least one flexible functional portion 15.

In the reduced flexibility configuration, however, the second auxiliary tooth 82 is engaged abutting against the second member tooth 92 and prevents the movement thereof, so that the auxiliary portion 33 is locked between the joining portion 34 and the movable engagement member 38.

In accordance with one embodiment, the auxiliary portion 33 is divided longitudinally into a first sector 33*a* and a second sector 33*b*, wherein each thereof is elastically deformable between the front hinge axis 20 and the rear hinge axis 40.

According to one embodiment, the first sector 33*a* and the second sector 33*b* are made in one piece and form the auxiliary portion 33.

According to a different embodiment, the first sector 33*a* and the second sector 33*b* are separate and distinct, i.e. deformable, preferably also movable, in an independent manner.

Specifically, in the reduced flexibility configuration, the movable engagement member 38 engages both said first sector 33*a* and said second sector 33*b*, i.e. the entire auxiliary portion 33 bends.

According to one embodiment, along the control axis C, the first auxiliary tooth 81 is aligned longitudinally with the first sector 33*a*, and the second auxiliary tooth 82 is aligned longitudinally with the second sector 33*b*.

Figure 7:
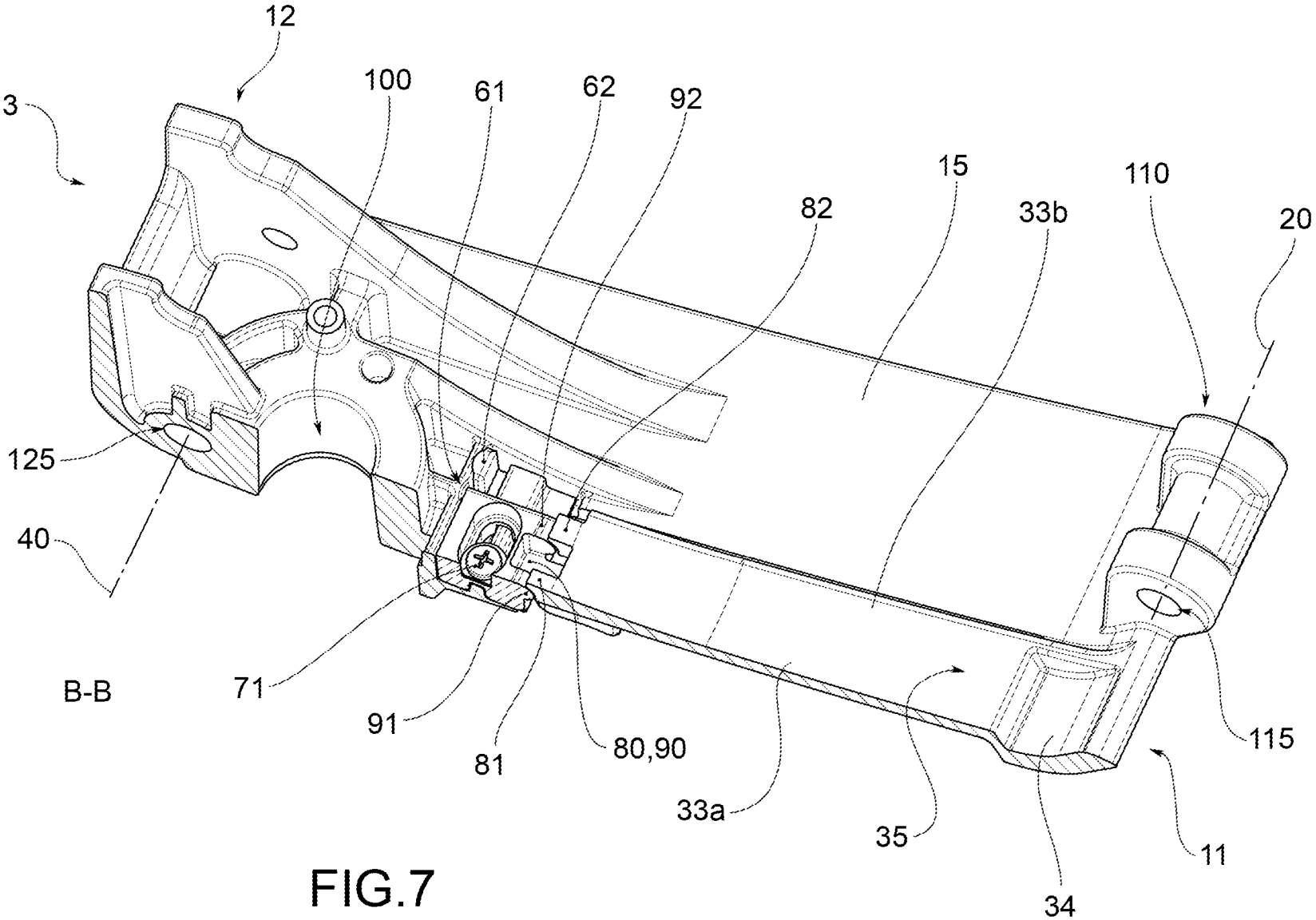
FIG. 7 shows a section of the oscillation mechanism of FIG. 6 along the section plane B-B.
Figure 8:
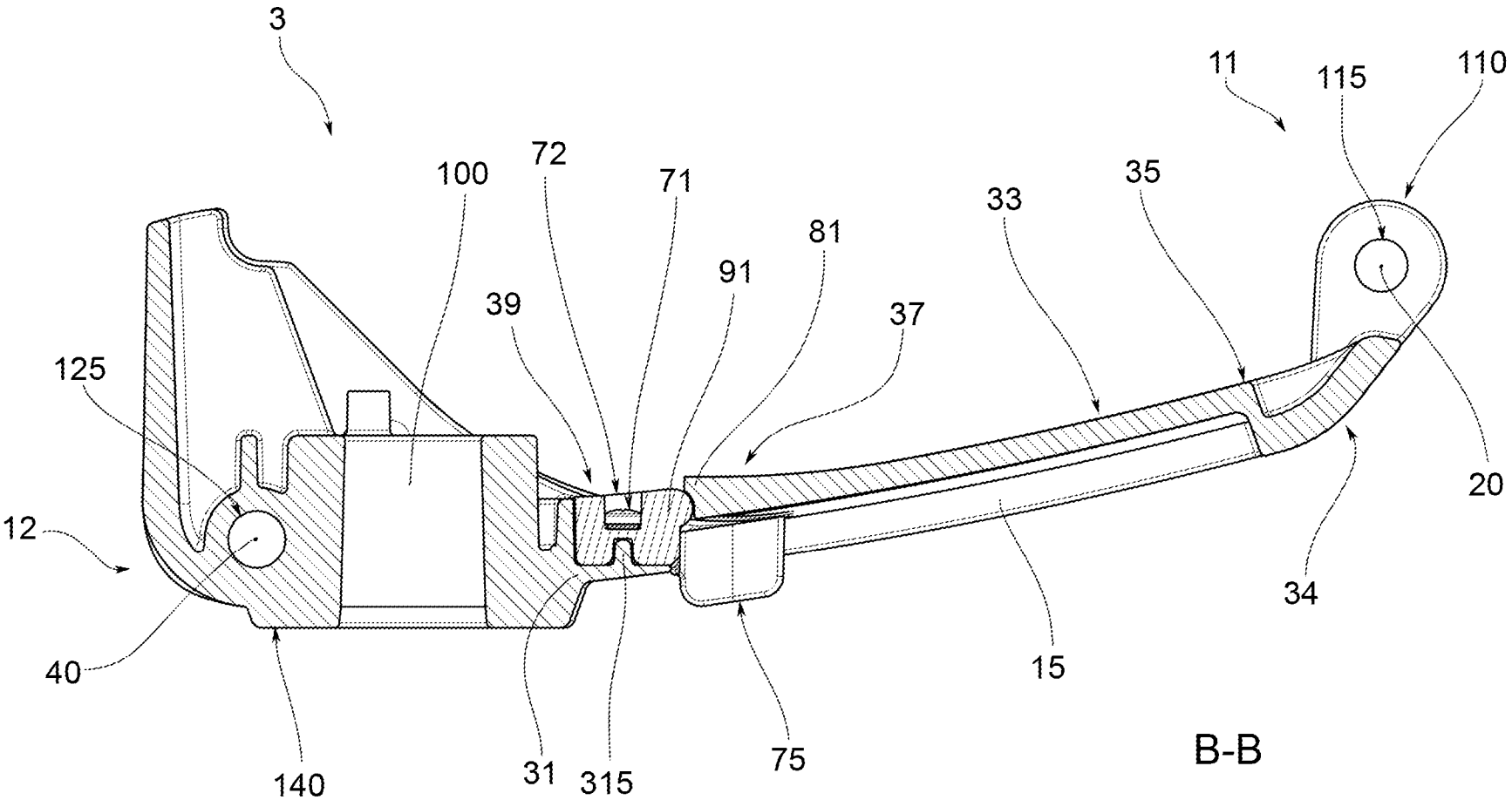
FIG. 8 shows a sectional view of the oscillation mechanism of FIGS. 6 and 7.
Figure 9:
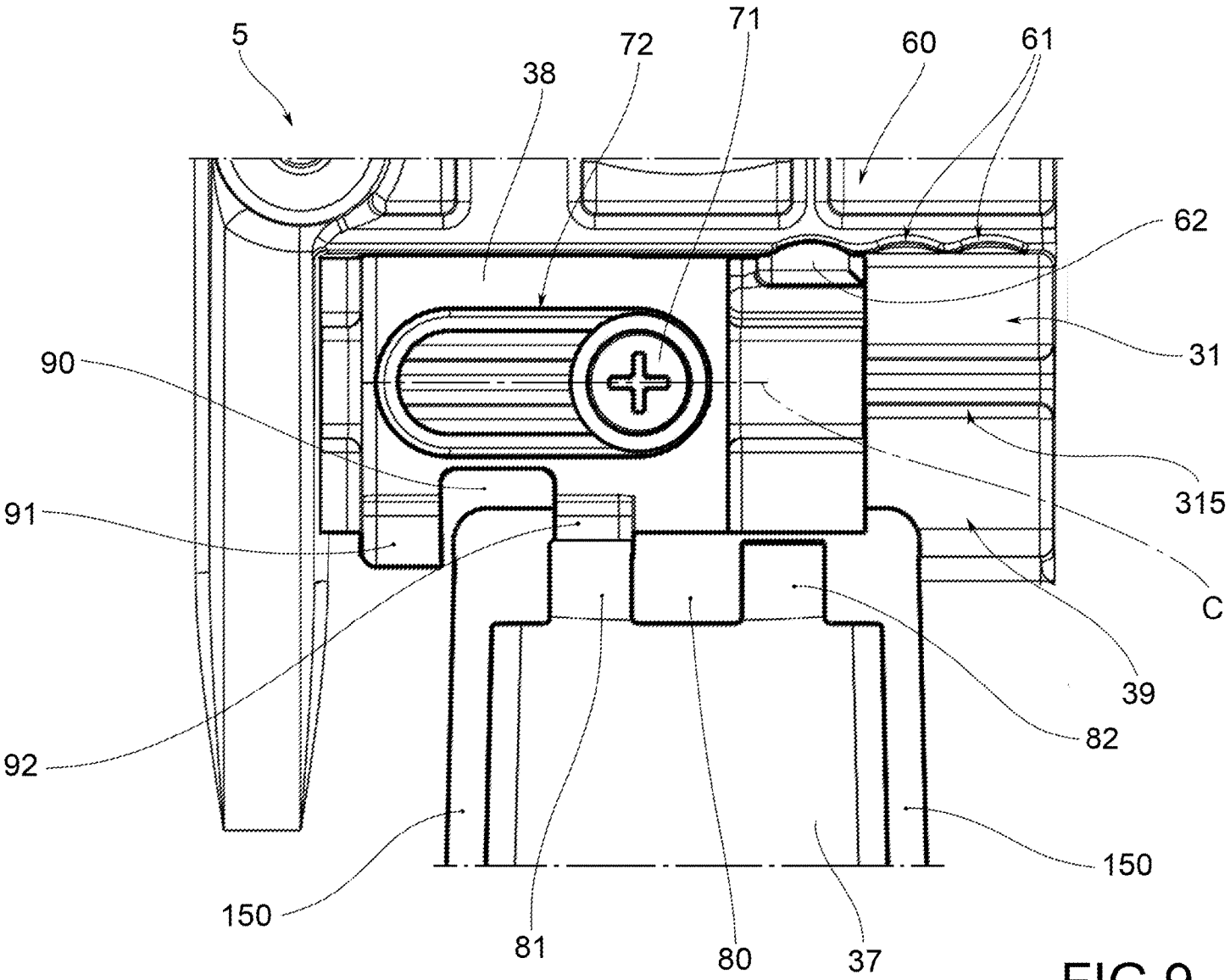
FIG. 9 shows an enlargement of some parts of the oscillation mechanism with an adjustment device configured in the intermediate flexibility configuration.

According to one embodiment, the adjustment device 5 is also configurable in a third configuration or intermediate flexibility configuration (FIG. 7), in which the movable engagement member 38 engages only one of the first sector 33*a* and the second sector 33*b*, for example the first sector 33*a*. Thus, in said intermediate flexibility configuration, only a portion of the auxiliary portion 33 bends, offering only partial resistance to deformation, thus stiffening the functional body 3 to a lesser extent in relation to the reduced flexibility configuration.

In particular, in the intermediate flexibility configuration, the movable engagement member 38 is positioned in a third position or intermediate position.

According to one embodiment, said intermediate position is situated within a translation segment comprised between the release position and the working position along the control axis C.

According to a different embodiment, the intermediate position is located outside said translation segment, i.e. beyond the release position or beyond the working position, along the control axis C.

According to one embodiment, the adjustment device 5 also comprises a handle 75 graspable by a user, engaged with the movable engagement member 38 in order to move it between the positions thereof, for example protruding laterally or inferiorly from the lower side 140 of the functional body 3. In one embodiment, the handle 75 is made in one piece with the movable engagement member 38.

According to one embodiment, the adjustment device 5 comprises aligning members 60 to ensure the correct positioning of the movable engagement member 38 and to prevent the accidental displacement thereof.

In particular, the functional body 3 has a plurality of contiguous alignment seats 61, for example situated in the rear portion 12, each corresponding to one position of the movable engagement member 38. Preferably, the movable engagement member 38 is provided with an alignment septum 62, preferably made in one piece and elastically deformable so as to engage by snapping into a relevant alignment seat 61.

By moving the movable engagement member 38, the alignment septum 62 deforms and exits the alignment seat 61 so as to engage the adjacent alignment seat 61.

In accordance with one embodiment, the functional body 3 is made in one piece, i.e. it is a single component that integrates the at least one flexible functional portion 15, preferably two flexible functional portions 15, and also the auxiliary portion 33, the joining portion 34 and the support portion 31 of the adjustment device 5.

Specifically, the functional body 3 comprises the at least one flexible functional portion 15, the joining portion 34 and the auxiliary portion 33 that constitute a single body which, by virtue of the elastic deformability thereof, allow for the oscillation of the seat 2 and/or the backrest 4.

According to one embodiment, the functional body 3 is made of a plastics material, for example by molding. For example, the functional body 3 is made of polyamide.

According to one embodiment, in the longitudinal direction, the at least one flexible functional portion 15 and/or the auxiliary portion 33 have zones of differentiated flexibility having different rigidities, for example made of different materials with different elastic characteristics, or having different sections and geometries therebetween.

An object of the present invention is also a chair or an armchair 1, comprising the oscillation mechanism 6 described above and also a seat 2, a backrest 4 and a stem 8.

Innovatively, the oscillation mechanism according to the present invention satisfies the needs of the sector, insofar as it makes it possible to effectively tilt the seat and/or the back of a chair or an armchair, and at the same time overcomes the aforementioned drawbacks, insofar as it makes it possible to vary the range and intensity of the oscillations of the chair or armchair.

Advantageously, the user may easily adjust the rigidity of the oscillation mechanism, according to the comfort needs thereof.

Advantageously, the oscillation mechanism is particularly structurally simplified. In fact, the deformable functional body integrates in a single piece the typical functions of the steel or aluminum box and the steel springs of the solutions of the known art.

Advantageously, the functional body is easily manufactured by means of the molding of plastics materials.

It is clear that a person skilled in the art, in order to satisfy current needs, could make modifications to the oscillation mechanism described above, all of said modifications being contained within the scope of protection as defined in the following claims.

What is claimed is:

1. An oscillation mechanism for a chair or an armchair comprising a seat and a backrest, wherein the oscillation mechanism comprises:

a functional body hingeable to the backrest in a rear hinge axis and hingeable to the seat in a front hinge axis, wherein the functional body comprises at least one flexible functional portion elastically bendable between the front hinge axis and the rear hinge axis for an oscillation of the seat and/or the backrest; and an adjustment device for adjusting a flexibility of the functional body, comprising:

a support portion connected to the at least one flexible functional portion;

at least one auxiliary portion comprising a first end connected to the at least one flexible functional portion, and a free end; and a movable engagement member supported by the support portion;

wherein the adjustment device is configurable in:

a high-flexibility configuration in which the movable engagement member is disengaged from the free end of the auxiliary portion, so that the auxiliary portion is configured in a cantilever fashion; and a reduced flexibility configuration in which the movable engagement member engages the free end, so that the auxiliary portion elastically bends between the front hinge axis and the rear hinge axis together with the at least one flexible functional portion.

2. The oscillation mechanism of claim 1, wherein the auxiliary portion is made in one piece with the at least one flexible functional portion.

3. The oscillation mechanism of claim 1, wherein the adjustment device comprises two flexible functional portions having extension between the front hinge axis and the rear hinge axis, and a joining portion made in one piece with the auxiliary portion and said two flexible functional portions.

4. The oscillation mechanism of claim 3, wherein the joining portion is proximal to the front hinge axis and the support portion is proximal to the rear hinge axis or vice versa.

5. The oscillation mechanism of claim 1, wherein the movable engagement member is movable along a circular or curvilinear section.

6. The oscillation mechanism of claim 1, wherein the movable engagement member is movable along a control axis parallel to the front hinge axis and/or to the rear hinge axis.

7. The oscillation mechanism of claim 1, wherein the auxiliary portion is divided into a first sector and a second sector elastically bendable between the front hinge axis and the rear hinge axis, and wherein, in the reduced flexibility configuration, the movable engagement member engages both said first sector and said second sector.

8. The oscillation mechanism of claim 7, wherein the adjustment device is further configurable in an intermediate flexibility configuration in which the movable engagement member engages only one of the first sector and the second sector.

9. The oscillation mechanism of claim 1, wherein the auxiliary portion comprises a first auxiliary tooth supported at the free end, wherein the movable engagement member comprises a first member tooth and a member seat, and wherein:

in the high-flexibility configuration, the first auxiliary tooth is still or freely movable in the member seat during an elastic deformation of the at least one flexible functional portion; and in the reduced flexibility configuration, the first auxiliary tooth is engaged abutting against the first member tooth.

10. The oscillation mechanism of claim 9, wherein the movable engagement member is movable along a control axis parallel to the front hinge axis and/or to the rear hinge axis, and wherein the first member tooth and the member seat are adjacent along the control axis.

11. The oscillation mechanism of claim 10, wherein the auxiliary portion comprises a second auxiliary tooth spaced apart from the first auxiliary tooth along the control axis, with which the auxiliary portion defines an auxiliary seat, wherein the movable engagement member comprises a second member tooth spaced apart from the first member tooth along the control axis, with which the movable engagement member defines the member seat, and wherein:

in the high-flexibility configuration, the second member tooth is still or freely movable in the auxiliary seat during the elastic deformation of the at least one flexible functional portion; and in the reduced flexibility configuration, the second member tooth is engaged abutting against the second auxiliary tooth.

12. The oscillation mechanism of claim 11, wherein the auxiliary portion is divided into a first sector and a second sector elastically bendable between the front hinge axis and the rear hinge axis, wherein, in the reduced flexibility configuration, the movable engagement member engages both said first sector and said second sector, and wherein, along the control axis, the first auxiliary tooth is aligned with the first sector and the second auxiliary tooth is aligned with the second sector.

13. The oscillation mechanism of claim 1, wherein the adjustment device further comprises a handle integrally connected with the movable engagement member for moving the movable engagement member between positions thereof.

14. The oscillation mechanism of claim 1, wherein the functional body comprises a connection hole engageable with a stem of the chair or of the armchair.

15. A chair or an armchair comprising a seat, a backrest back, a stem and the oscillation mechanism of claim 1.

* * * * *